US005665206A

United States Patent [19]

Niskanen

[11] Patent Number: 5,665,206

[45] Date of Patent: Sep. 9, 1997

[54] METHOD AND DEVICE IN A PRESS SECTION OF A PAPER MACHINE FOR DETACHING A WEB FROM A FACE OF A PRESS ROLL

[75] Inventor: Juhani Niskanen, Jyvaskyla, Finland

[73] Assignee: Valmet Corporation, Helsinki, Finland

[21] Appl. No.: 555,091

[22] Filed: Nov. 8, 1995

Related U.S. Application Data

[63] Continuation-in-part of Ser. No. 81,277, Jun. 23, 1993, abandoned.

[30] Foreign Application Priority Data

Jan. 18, 1991 [FI] Finland ..... 910288

[51] Int. Cl.[6] ..... D21F 3/02

[52] U.S. Cl. ..... 162/206; 162/306; 162/359.1; 162/360.3

[58] Field of Search ..... 162/206, 290, 162/359.1, 360.3, 252, 306

[56] References Cited

U.S. PATENT DOCUMENTS

| | | | |
|---|---|---|---|
| 4,016,032 | 4/1977 | Kankaanpaa | 162/305 |
| 4,889,598 | 12/1989 | Niskanen | 162/199 |
| 4,919,759 | 4/1990 | Ilmarinen et al. | 162/206 |
| 4,948,466 | 8/1990 | Jaakkola | 162/207 |
| 5,232,555 | 8/1993 | Daunais et al. | 162/193 |

FOREIGN PATENT DOCUMENTS

| | | |
|---|---|---|
| 0364114 | 4/1990 | European Pat. Off. . |
| 743720 | 6/1976 | Finland . |
| 75890 | 4/1988 | Finland . |
| 89085 | 7/1988 | Finland . |
| 881711 | 10/1989 | Finland . |
| 894609 | 3/1990 | Finland . |

*Primary Examiner*—Karen M. Hastings
*Attorney, Agent, or Firm*—Steinberg, Raskin & Davidson, P.C.

[57] ABSTRACT

Method and device in the press section of a paper machine for detaching a web from a smooth mantle face of a press roll. In the method and device, a transfer zone is employed, over which a press fabric or a particular transfer fabric is passed so as to accomplish a closed draw of the web. The transfer zone as well as the fabric form a transfer nip or a transfer zone with the roll face. At the transfer point, the temperature level of the roll face and/or of the web is set or regulated so high that the pressure of saturated vapor of the water present in connection with the web and with the roll face which corresponds to the temperature level is substantially equally high as, or just little higher than, the pressure that has been set to prevail in the transfer zone, the pressure being preferably lower than the atmospheric pressure.

20 Claims, 3 Drawing Sheets

METHOD AND DEVICE IN A PRESS SECTION OF A PAPER MACHINE FOR DETACHING A WEB FROM A FACE OF A PRESS ROLL

This application is a continuation-in-part of U.S. patent application Ser. No. 08/081,277 filed Jun. 23, 1993 now abandoned.

FIELD OF THE INVENTION

The present invention relates to a method in a press section of a paper machine for detaching a web from a smooth mantle face of a press roll, in which method a transfer zone is employed. In the transfer zone, a press fabric or a particular transfer fabric is passed into engagement with the web so as to accomplish a closed draw of the web from the smooth mantle face to the transfer fabric.

Further, the present invention relates to a press section of a paper machine, comprising an arrangement of press rolls which form one or several press nips with one another, the web being detached from a smooth-faced roll in the press section by means of a transfer-suction roll or an equivalent transfer member and being transferred further to a subsequent drying section or into a separate nip in the press section. In the press section, a revolving suction-transfer roll or a corresponding static suction-transfer box has been arranged to form a transfer nip or a transfer zone, which accomplishes a closed draw of the web from the smooth-faced roll to a transfer fabric running over the transfer-suction roll or to the transfer member. In the transfer nip or transfer zone, the web is subjected to a negative pressure which attempts to detach the web from the roll face.

BACKGROUND OF THE INVENTION

In the prior art, various compact and closed press sections are known, in which there is a combination of press rolls, whose press rolls form, as a rule, at least three press nips with one another. Of these prior art press sections, reference should be made to the assignee's "Sym-Press II" press section and the assignee's "Sym-Press O" press section (""=trade marks).

In a typical "Sym-Press II" press section, the first twin-wire nip is formed between a hollow-faced lower press roll and an upper press-suction roll. The suction roll forms the second nip with the smooth-faced center roll of the press, and the third press nip is also formed in connection with the center roll. Further, this press section may include a separate nip, as a rule a fourth nip in the press, after which the web is transferred to the subsequent drying section.

In a typical "Sym-Press O" press section, the first twin-felt horizontal nip is formed between a lower hollow-faced roll and an upper press-suction roll, after which the web follows the upper fabric as a vertical run into the second nip, which is formed between a hollow-faced roll separate from the rolls in the first nip and the smooth-faced center roll. In connection with the center roll, a third press nip, which is provided with a felt, is formed by means of a hollow-faced press roll.

In the manner known in prior art, the web is detached from the smooth face of the center roll in the press section by means of a pulling force parallel to the running direction of the web so that the web will be passed in a free, unsupported draw from the smooth-faced center roll onward. This free draw is quite critical in view of the operation of a paper machine. In this free draw, to produce the detaching force, a speed difference is employed which stretches the web causing certain significant drawbacks. Moreover, this unsupported draw forms a problematic point for the web rendering it susceptible to breaks and stoppages of the paper machine.

In general, the prior art has not offered efficient means for controlling the detaching of the web from the smooth-faced center roll and possibly to be passed in a subsequent free draw. The unfavorable properties of granite, which is commonly used as the material of the center roll, have for their part, also restricted the control of the detaching of the web and control of the web running in the free draw.

With ever increasing running speeds of paper machines, the free draw of the web has become an ever more important problem point. In the near future, paper machine running speeds of an order of as high as about 2000 m/min are contemplated. The open draw of the web from a smooth-faced roll in the press forms or will form a bottleneck which for its part prevents increased running speeds of paper machines.

It is a further problem that, in a paper machine, different paper qualities are often produced, whose adhesion to the smooth face of the center roll is different, which results in variations in the necessary detaching tension of the web to be provided in the conventional web-detaching arrangement mentioned above.

In a "Sym-Press II" press section, in the second and third press nips formed in conjunction with the center roll, the surface properties of the center roll must be such that the moist web adheres to the roll face as well as possible. On the other hand, the web should be detached from the roll face quite readily for transfer to the subsequent drying section. The fulfillment of these paradoxical requirements has not been too successful in every respect by the prior art arrangements.

In the prior art, some transfer-suction rolls have been suggested which have been meant to form a transfer nip against the smooth-faced center roll in the press section. It is a feature common to these prior art transfer-suction rolls that they apply only suction to the transfer zone defined between the transfer-suction roll and the center roll and do not operate in the intended way in practice. This is due to the fact that, by means of the prior art transfer-suction rolls, it has not been possible to separate the paper web from the center roll by suction alone, because, at the transfer point, the suction force causes the web to adhere to the smooth face of the center roll tightly and, as a rule, even by the intermediate of a water film. This effect is caused in part by the porosity of the fabric and the web. Thus, the negative pressure applied to the web in the suction zone of the transfer-suction roll produces a corresponding negative pressure (partial vacuum) between the web and the smooth face of the center roll. Consequently, the web is not detached from the smooth face of the center roll but rather the partial vacuum between the web and the smooth face of the center roll causes the web to follow the smooth face of the center roll, i.e., detachment does not occur. Owing to the above, one has been content with considering it almost as a law of nature that the web cannot be detached from a smooth roll face by suction alone.

With respect to the prior art related to the invention, reference is also made to the assignee's Finnish Patent Application Nos. 870308 and 870309, which correspond to U.S. Pat. Nos. 4,919,759 and 4,889,598, respectively, which are incorporated by reference herein.

In FI 870308, a method and a device are described for detaching of the web by means of an unsupported draw from a smooth-faced press roll. In this method, the temperature of the press roll is regulated and, by means of this regulation, the adhesion between the roll face and the paper web to be detached is affected, and thereby the detaching angle and/or the detaching tension of the paper web is set within an optimal range.

In FI 870309, a method and a device are described in which the web is detached from a smooth roll face as an unsupported draw and, in the area of the detaching point, a momentary and local induction heating effect is applied to the web from outside the smooth-faced press roll, by means of which heating effect the water present between the web and the roll face is heated, preferably vaporized, locally within the area of the detaching point to detach the web from the roll face.

It is important to note that FI 870309 does not describe the use of a transfer-suction zone in which the prevailing pressure is lower than atmospheric pressure, i.e., in which negative pressure is applied, or a transfer-suction zone in which suction is applied before the web is transferred from the center roll. Indeed, as shown in FIG. 2 therein, negative pressure is applied not even at the detaching point but only after the detaching point, i.e., after the web has already been transferred from the roll, so that the web remains on the drying wire in a straight run from the center roll to the suction zone of the leading roll. Blowings produce a positive pressure and not a negative pressure at the heating device and at the detaching point. Thus, FI 870309 does not use suction in a transfer zone before the web has separated from the smooth roll face in conjunction with the application of heat in the transfer zone.

It is also important to note that in FI 870309, electromagnetic inductive heating is applied to heat the web. Therefore, the requirement that the center roll include conductive material limits the selection of materials for the center roll.

In summary, in the prior art, there are press sections which include means for applying suction through a transfer-suction roll to attempt to detach a web from a smooth mantle face, which are unsuccessful in view of the fact that the suction unavoidably increases the adherence of the web to the smooth mantle face as noted above, but do not describe the specific application of heat to the web and/or mantle face to aid in the detachment of the web from the smooth mantle face in conjunction with the application of suction. Also, there are press sections which include means for applying heat, albeit a local and momentary heating effect, to a roll to detach a web therefrom, e.g., FI 870309, but do not describe the application of suction prior to the detachment of the web from the mantle face. However, there is no suggestion in the prior art to combine the application of suction prior to detachment of a web from a smooth mantle face and the application of heat in a specific relationship to provide for efficient detachment of the web from the smooth mantle face.

In the following, typical tensions that occur in a free draw of the web will be examined in the light of an example.

In a free draw of any web-like material, the tension arises, wherein

F=tension [N/m]

Q=grammage [kg/m$^2$]

v=velocity [m/s]

Since the web has a certain finite breaking strength $F_M$, the formula for the limit speed is $$v = \frac{F_M}{\rho}$$

Typically, the wet breaking strength of newsprint ($F_M$) is about 200 N/m, and the corresponding grammage is about 42 g/m$^2$, and the moisture content in the first free gap in the nip is about 42%.

$$\rho = 0.1 \text{ kg/m}$$

$$v_{limit} = \sqrt{\frac{200}{0.1}} \text{ m/s} = 44.7 \text{ m/s}$$

On the other hand, the typical strength values are average values, but the web breaks at the weakest point. If there is an occasional, local strength of about 50 N/m in the web, the following velocity is obtained:

$$v_{limit} = \sqrt{\frac{56}{0.1}} \text{ m/s} = 23.7 \text{ m/s}$$

The above velocity $v_{limit}$ is at present a typical running speed employed in paper machines for which reasons the web breaks now and then at the open draw.

If it is desirable to increase the speed of a paper machine, the web must be made generally stronger or more homogeneous (no weak points), or the free gaps in the run of the web in the press section must be eliminated. The present invention endeavors to solve these problems by means of elimination of the free gaps.

OBJECTS AND SUMMARY OF THE INVENTION

The general object of the present invention is to provide novel means for detaching a web from the center roll or equivalent in a press section and for transferring the web into a separate nip or to the drying section following the press section.

It is a more specific object of the present invention to provide a method and a device for detaching the web from a smooth-faced press roll wherein the web need not be stretched, i.e., it is unnecessary to employ so-called draw and speed difference. Thus, the object of the invention is to provide a press section in which, when necessary, it is possible to use a fully closed draw when the web is transferred from the center roll or from another corresponding roll in the press section to the drying section, as a rule onto its drying wire, or onto the press fabric of a separate nip.

It is another object of the present invention to provide a new and improved method and device for detaching a web from a smooth-faced press roll which solves the problem in prior art press section that when negative pressure is applied to a web to detach the web from the smooth-faced press roll, the negative pressure causes adhesion of the web to the smooth face of the press roll so that the web tends to follow the press roll and is not separated therefrom.

It is yet another object of the invention to provide a new and improved method and device for detaching a web from a smooth-faced press roll which enables a wider selection of the material for the center roll, i.e., it is not limited to granite and does not necessarily include a conductive material.

It is an important goal of these objects to permit an increased running speed of the paper machine so that the degree of utilization of the machine can be kept high.

In view of achieving the objects stated above, others and those that will come out later, the method of the invention is mainly characterized in that, at the transfer point, the temperature level of the roll face and/or of the web is set or regulated so high that the pressure of saturated vapor of the water present in connection with the web and with the roll face which corresponds to the temperature level is almost equally high as, or higher than, the pressure prevailing in the transfer zone.

On the other hand, the device in accordance with the invention is mainly characterized in that the device comprises a heating device or devices, by means of which the temperature level at the web that enters to the transfer point and/or the temperature level of the roll face can be raised to such a high level that a detrimentally high negative pressure, which would prevent the closed transfer of the web, is not formed at the transfer point.

In the method in accordance with the invention for detaching a web from a smooth mantle face of a press roll in a press section of a paper machine, the press section has a transfer zone extending substantially between a point at which a transfer surface engages the web carried on the smooth mantle face and a point at which the web is separated from the smooth mantle face of the press roll for transfer to the transfer surface. Air is drawn from the transfer zone through a transfer press element with which the transfer surface is associated by applying a first negative pressure in the transfer zone through the transfer press element in a direction toward the web. Simultaneous with the application of negative pressure in the transfer zone, at least one of the web and the mantle face of the smooth-faced press roll is heated to a certain temperature causing water between the mantle face of the smooth-faced press roll and the web and/or in the web to be heated and vaporized in the transfer zone. The water vapor has a second pressure. The first pressure and the temperature to which the web and/or mantle face is/are heated resulting in the second pressure, are regulated as a function of each other, preferably so that the absolute value of the second pressure is substantially equal to or greater than the absolute value of the first pressure.

In more specific embodiments of the method, the first pressure applied in the transfer zone is selected to be at least about 80% of the second pressure of the saturated water vapor corresponding to the heating temperature of the mantle face of the smooth-faced press roll and/or the web.

Furthermore, the first pressure and the temperature which provides the second pressure can be regulated as a function of each other to prevent the formation of a vacuum in an opening nip defined by the web after it has separated from the smooth-faced press roll and the smooth-faced press roll and to provide a pressure difference in the transfer zone which produces a force field forcing the web from the smooth-faced press roll to the transfer element. The negative pressure normally present in the opening nip is caused by the pumping action of the web and the rotational movement of the smooth-faced press roll. Normally, a vacuum is present in the opening nip as a result of the pumping action. However, the application and suction and heat in the invention can be regulated so that not only is the absolute value of the second pressure is substantially equal to or greater than the absolute value of the first pressure but also so that a positive pressure prevails in the opening nip.

In another embodiment of the method in accordance with the invention for detaching a web from a smooth mantle face of a press roll, the web is carried on the smooth-faced press roll and through the nip, air is drawn from the transfer zone through a transfer press element with which the transfer surface is associated by applying a first negative pressure through the transfer press element and the entire circumference of the mantle face of the smooth-faced press roll is heated to a certain temperature causing water between the mantle face of the smooth-faced press roll and the web and/or in the web to be heated and vaporized in the transfer zone. The water vapor has a second pressure. To ensure an efficient detachment of the web from the smooth mantle face, the first pressure and the temperature to which the web and/or mantle face is/are heated, resulting in the second pressure, are regulated as a function of each other such that the absolute value of the second pressure is substantially equal to or greater than the absolute value of the first pressure.

The press section of a paper machine in accordance with the invention basically comprises a plurality of press rolls over which a web is arranged to run, at least two of the press rolls being arranged in a nip-defining relationship, a first one of the press rolls having a smooth mantle face and a transfer press element defining a transfer zone extending substantially between a point at which a transfer surface engages the web carried on the smooth mantle face of the first roll and a point at which the web is separated from the smooth mantle face of the press roll for transfer to the transfer surface. The web is transferred in a closed draw from the smooth mantle face of the first roll onto the transfer surface. Suction means are provided for subjecting the web to a negative pressure in the transfer zone at least prior to detachment of the web from the smooth face of the smooth-faced roll. The suction means are arranged in conjunction with the transfer press element such that suction is applied and air is drawn from the transfer zone through the transfer press element. Heating means heat the web and/or the smooth mantle face of the smooth-faced roll such that the temperature of the web and/or the mantle face in the transfer zone reaches a certain temperature. Also, the press section includes regulation means for regulating the magnitude of negative pressure applied by the suction means and the temperature to which the heating means heat the web and/or the smooth mantle face of the smooth-faced roll as a function of each other to maintain a sufficient level of negative pressure in the transfer zone to prevent the web from adhering to the smooth-faced roll and separating from the transfer press element after the transfer zone.

BRIEF DESCRIPTION OF THE DRAWINGS

In the following, the invention will be described in detail with reference to some exemplifying embodiments of the invention illustrated in the figures in the accompanying drawing. However, the invention is in no way strictly confined to the details of these embodiments.

DETAILED DESCRIPTION OF THE INVENTION

Figure 1:
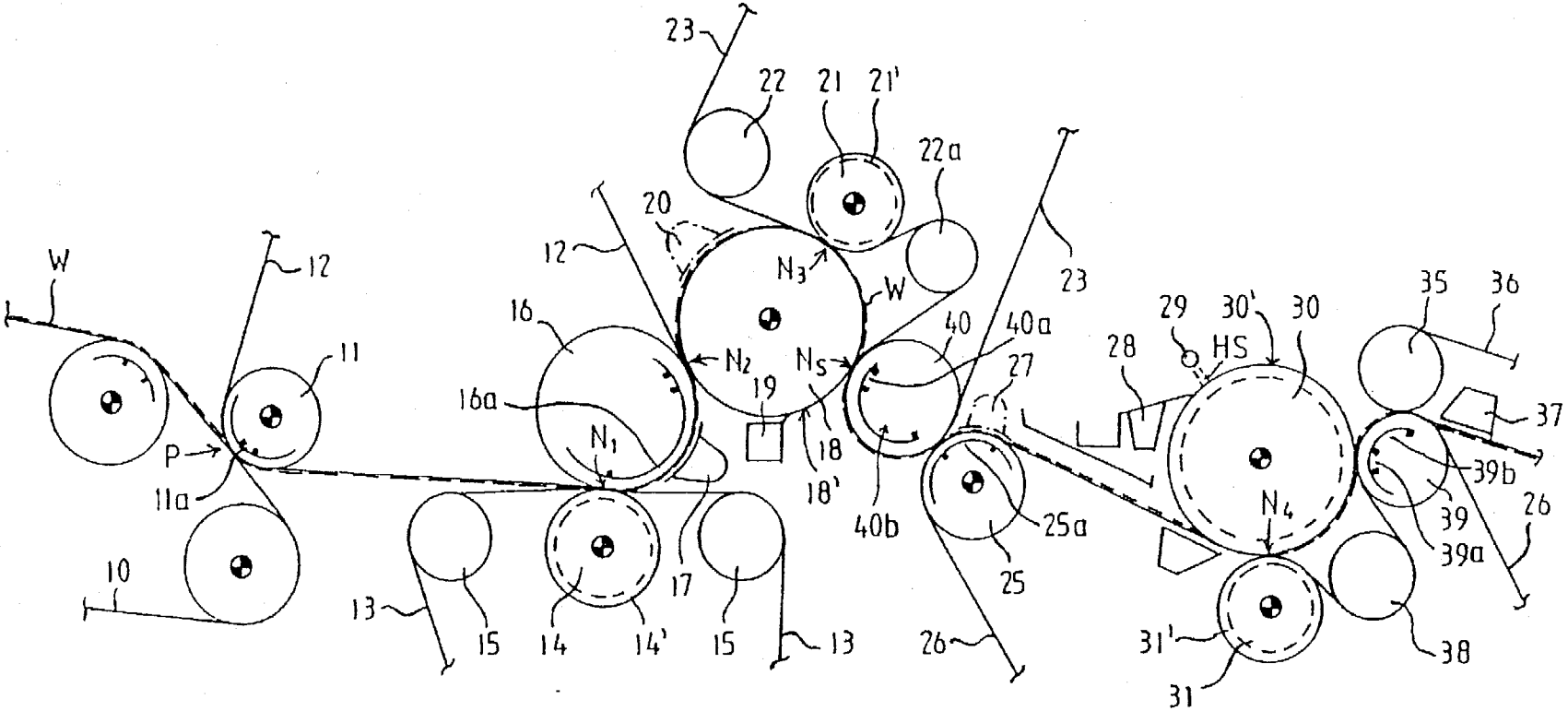
FIG. 1 is a schematic side view of the environment of application of the invention and of a first embodiment of the invention, in which the press fabric of the third nip is used as the transfer fabric in the transfer from the center roll.
Figure 2:
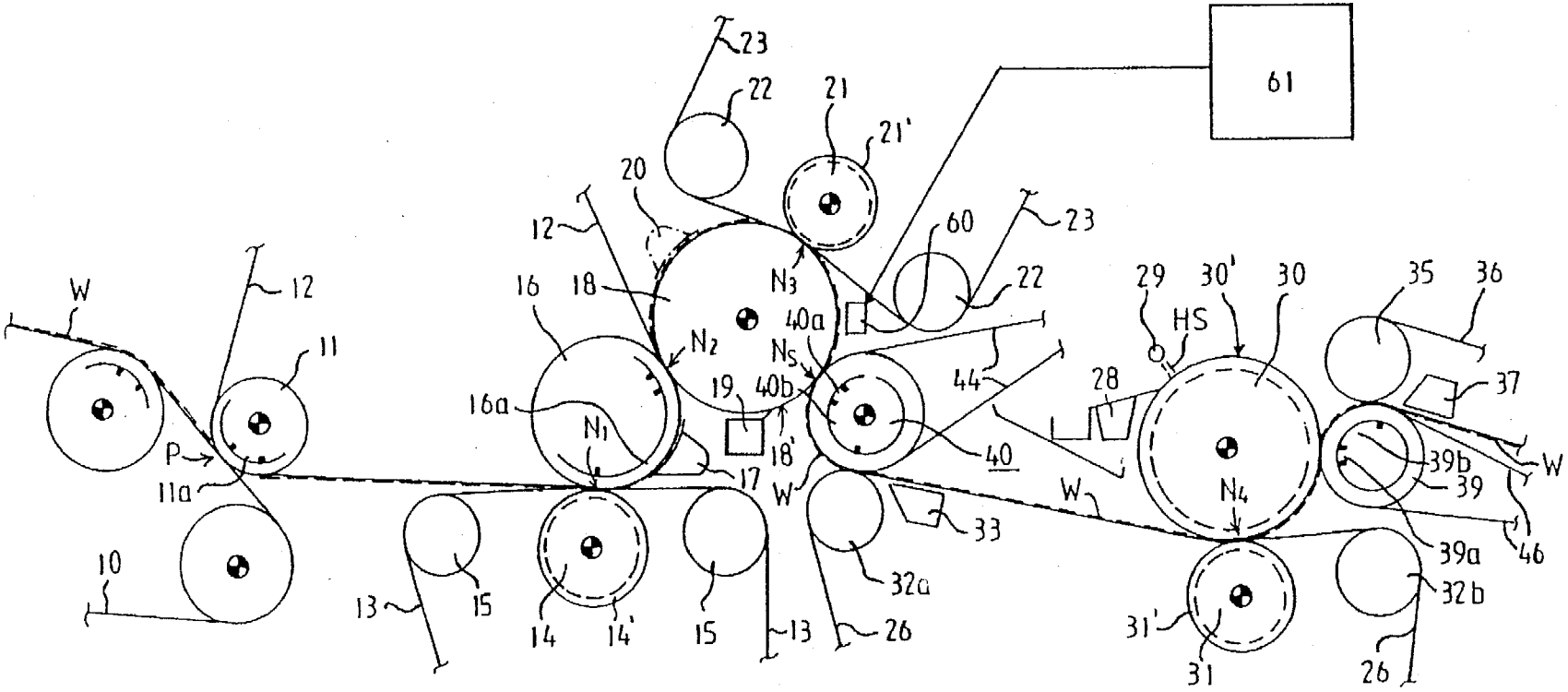
FIG. 2 shows, in a way corresponding to FIG. 1, an embodiment of the invention in which a separate transfer fabric is used that runs around the transfer-suction roll.

Referring to the accompanying drawings wherein like reference numerals refer to the same or similar elements, FIGS. 1 and 2 are schematic illustrations of a press section of a paper machine, in which a paper web W, which comes from a forming wire 10 of the former, is dewatered by pressing. The web W is transferred from the wire 10 at a pickup point P by means of a press felt 12 on a suction zone 11*a* of a pick-up roll 11. On the pick-up felt 12, the web W is transferred into a first dewatering nip $N_1$, which is formed between a press-suction roll 16 and a hollow-faced 14' lower press roll 14. The first nip $N_1$ is a two-felt nip, and it includes a lower felt 13 guided by guide rolls 15.

In FIGS. 1 and 2, owing to the suction zone 16*a* of the suction roll 16, after the nip $N_1$ the web W follows the felt 12 into the second nip $N_2$, which is formed between the suction roll 16 and the smooth-faced 18' center roll 18 in the press. Between the nips $N_1$ and $N_2$ there is a steam box 17, which heats the web W directly against the suction roll 16. The third nip $N_3$ in the press is formed between the center roll 18 and a hollow-faced 21' press roll 21. A press felt 23 is guided by guide rolls 22 to run through the third nip $N_3$. On the lower sector of the center roll 18, there is a doctor 19 which keeps the smooth face 18' of the center roll 18 clean and detaches the web passing to broke from the face 18'.

In FIGS. 1 and 2 the press rolls 14,16,18, and 21 form a compact combination of rolls in which there are three subsequent nips $N_1$, $N_2$, $N_3$, through which the web W runs as a closed draw, being constantly supported by a felt or roll face. A fourth, separate nip $N_4$ is formed between a smooth-faced 30' large-diameter press roll 30 and a lower hollow-faced 31' press roll 31 downstream of the center roll 18 in the running direction of the web. After the fourth nip $N_4$, the web W follows the smooth face 30' of press roll 30 and is detached from press roll 30 to he passed onto a guide roll 39. Thereafter, the web is transferred onto the drying wire 36 of the drying section which is guided by the guide roll 35. The web W is made to adhere to the drying wire 36 by means of a suction box 37 and is then passed on the wire 36 into a multi-cylinder dryer (not shown). On the upper sector of the upper press roll 130 of the separate nip $N_4$, there are jet means 29 followed by a doctor 28 which cooperate to keep the roll face 30' clean.

According to FIG. 1, after the fourth nip $N_4$, the press fabric 26 is separated from the web W by means of the guide roll 38, being passed back into connection with the web W into the transfer nip 30/39 over the transfer-suction roll 39. On the first suction zone 39*a* of the transfer-suction roll 39, the web W is detached from the roll face 30', and the web W is transferred over the roll 39 on the press fabric 26, being secured by the negative pressure in the suction zone 39*b*. The web W is detached from the fabric 26 by means of the suction box 37 and is transferred onto the drying wire 36. Differing from the above, in FIG. 2, the press fabric 26, being guided by the guide roll 32*b*, is separated from the web W, which is transferred on the roll face 30' onto the suction zone 39*a* of the transfer-suction roll 30. Over the transfer-suction roll 39, a particular transfer fabric 26 is passed, on which the web W is transferred onto the drying wire 36, being secured by the second suction zone 39*b* of the roll 39.

The press construction described above is substantially known in prior art, and it is described above just as a background and as an environment of application for the present invention.

Specifically, in the invention, on the suction sector 16*a* between the first and the second nip, there is a first steam supply box 17. In a corresponding manner, between the second and third nip $N_2$ and $N_3$, there is a second steam supply box 20 or other suitable heating means operating against the web W. The hot steam from boxes 17,20 serve to raise the temperature of the mantle face of the roll 18. By means of the hot steam fed out of the boxes 17 and 20, it is also possible to affect the elastic properties of the fibers in the web and the viscosity and the surface tension of the water present in the web so that the dewatering is intensified in the nips $N_2$ and $N_3$. According to the invention, the temperature T of the web W and/or the temperature of the face 18' of the center roll 18 is raised to such a level that the detaching of the web W and its transfer from the roll face 18' can be carried out successfully in the transfer nip Ns. The raising of the temperature level T of the web W may take place by means of internal heating of the center roll 18, an example of which is given in FIG. 4 by the axial bores 18*b* made into the roll mantle 18*a*, into which bores a heating medium, such as hot water or steam, is passed. Instead of, or in addition to, the internal heating of the roll 18, the roll mantle 18*b* may be by means of the steam boxes 17 and 20, in particular by means of the steam box 20, and also by means of various electric heaters, of which an induction heater 60 is shown as an example in FIG. 2.

Figure 4:
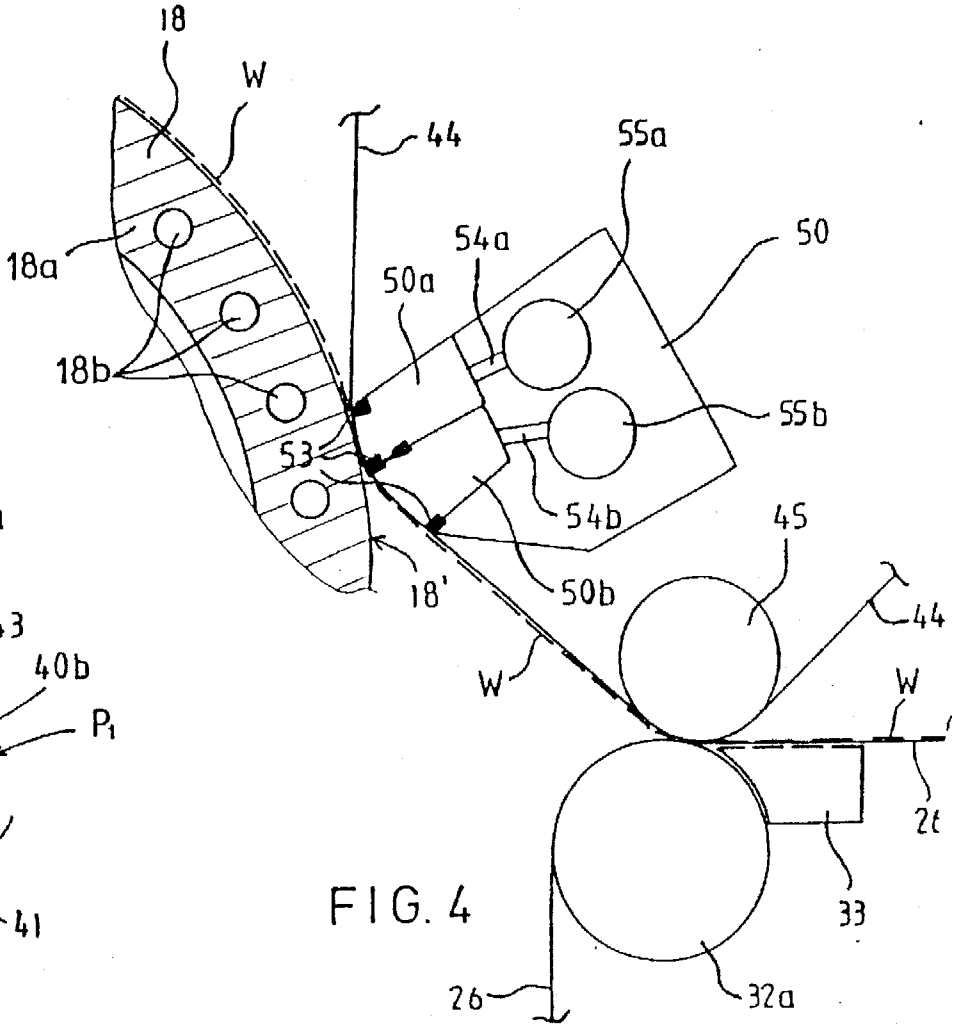
FIG. 4 shows an exemplifying embodiment of the invention in which the suction transfer takes place by means of a static transfer-suction box that comprises two parts.

The amount of heat applied to the web and/or the roll face, e.g., the amount of hot steam from boxes 17,20, is regulated by a regulation system 100 coupled to the steam boxes 17,20 or to the apparatus which feeds the heating medium into the axial bores of the roll (shown in FIG. 4). In this manner, it is possible to control the temperature to which the web and/or the roll face is/are heated.

After the third nip $N_3$,the web W follows the smooth face 18' of the center roll 18, from which it is detached as a fully closed draw in accordance with the invention by means of a transfer-suction roll 40 provided with a drive or by means of a transfer-suction box 50 (FIG. 4). In FIG. 1, by means of the suction zones 40*a*,40*b* of the transfer-suction roll 40, the web W is transferred on the suction zone 25*a* of the second lower transfer-suction roll 25 onto the press felt 26, which carries the web W on its upper face into the fourth, separate nip $N_4$ in the press section. The transfer-suction roll 40 and the transfer-suction box 50 defines a transfer zone extending substantially between a point at which a transfer surface, e.g., a fabric 23,44 running over the transfer-suction roll 40 or transfer-suction box 50, engages the web carried on the smooth mantle face of press roll 18 and a point at which the web is separated from the smooth mantle face of press roll 18 for transfer to the transfer surface.

According to FIG. 1, the press felt 23 of the third nip $N_3$ is passed after the nip $N_3$ onto the guide roll 22a and from it into the transfer nip $N_s$ so that the press felt 23 operates as a transfer fabric, which runs around the transfer-suction roll 40 and on which the web W is transferred on the suction zone 25*a* of the second transfer-suction roll 25 onto the lower fabric 26 of the fourth press nip $N_4$.

According to FIG. 2, a separate, dedicated transfer fabric 41 is arranged to run around the transfer-suction roll 40, which fabric 41 is passed into the transfer nip $N_s$ and separated from the transfer-suction roll 40 so that the web W follows the lower fabric 26 of the fourth press nip $N_4$. The transfer is secured, e.g., by means of appropriate selection of the surface properties of the fabrics 26 and 41 and possibly by means of the suction box 33. In connection with the loop of the transfer fabric 41, there are guide rolls and conditioning devices known per se, not shown in FIG. 2.

As shown in FIGS. 1 and 2, the transfer of the web W from the smooth face of the center roll 18 takes place as a fully closed draw on the transfer-suction roll 40 aided by the negative pressure present in its interior and effective on the suction zone 40a. The suction zone 40a is followed by the second suction zone 40b of the transfer-suction roll 40, on which the level of negative pressure is lower than that on the zone 40a, ensuring that the web W remains on support of the transfer fabric 23,41. It is an important feature in the embodiment of the closed draw of the invention that, before the transfer point, the smooth face 18' of the center roll 18 and/or the web W has been heated by heating means, such as steam boxes 17,20 or the heating medium passes through axial bores in press roll 18, to such a temperature level T that on the suction zone 40a of the suction roll 40, when the web W is being sucked off the face 18' of the center roll 18, no vacuum is formed in the area between the face 18' and the web W but, instead, a steam pressure $P_s$ corresponding to the temperature T is formed, which steam pressure is, in the present invention, arranged so that its absolute value is higher than the absolute pressure $P_o$ in the suction zone ($P_s>P_o$). By means of the pressure difference $P_s-P_o$, a force field is produced which presses the paper web W from the roll face 18' onto the transfer fabric 23,44.

To provide for this relationship between the steam pressure $P_s$ corresponding to the temperature level T to which the web and/or roll face are heated, the suction applying means, i.e., the transfer-suction roll 40 or the transfer-suction box 50, are connected to the regulation system 100. Thus, the regulation system 100 serves to regulate the pressure $P_o$ and the temperature T to which the web and/or mantle face is/are heated, to thereby regulate the pressure $P_s$, as a function of each other such that the absolute value of the pressure $P_s$ is substantially equal to or greater than the absolute value of the pressure $P_o$. It is noted that the "function" which governs the application of suction and heat may be constituted by a limit imposed on either the level of suction or the heating temperature when one of these physical quantities is known and used.

In the following, mainly with reference to FIG. 3, the physical background of the method in accordance with the invention will be described in more detail.

Figure 3:
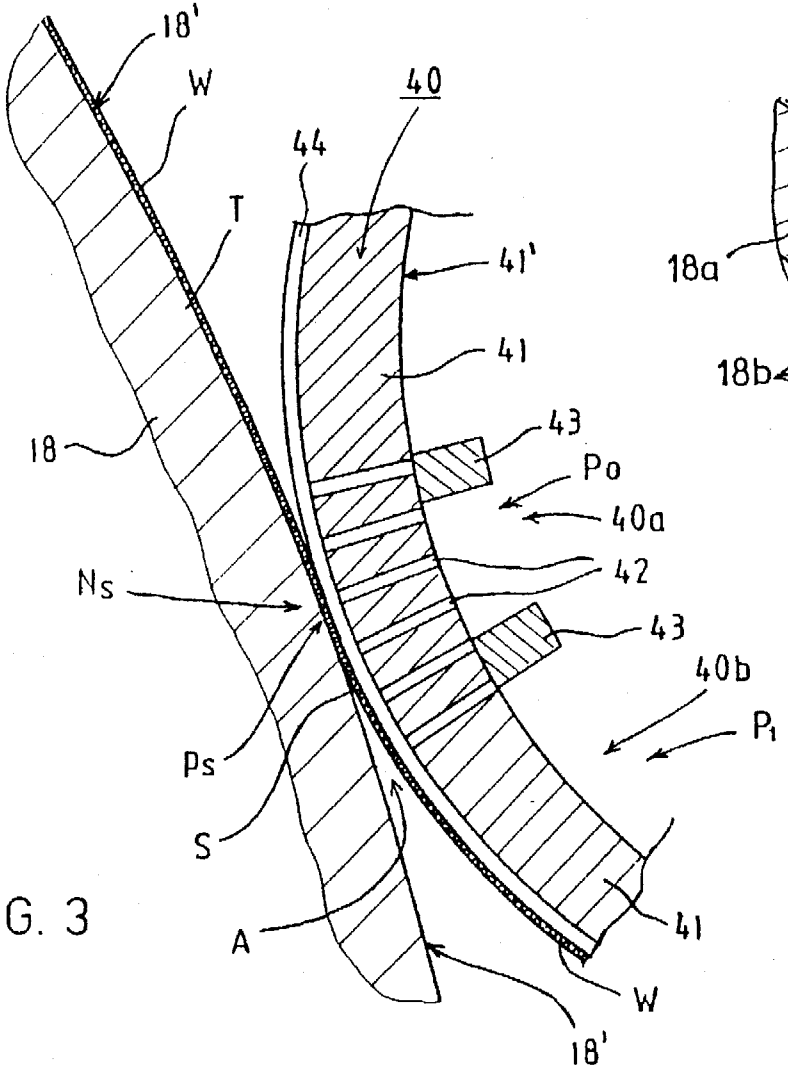
FIG. 3 is a vertical sectional view in the machine direction of a transfer nip in accordance with the invention as accomplished by means of a transfer-suction roll.

FIG. 3 shows the environment of the transfer nip $N_s$ between the center roll 18 and the transfer-suction roll 40. The transfer-suction roll 40 includes a perforated 42 roll mantle 41, in whose interior there are suction boxes. In FIG. 3, in respect of the suction boxes, just the sealing ribs 43 of the first suction zone 40a are shown, which operate against the smooth inner face 41' of the roll mantle 41.

The paper web W enters into the transfer nip $N_s$ on the smooth face 18' of the center roll 18. As a rule, the paper web W adheres tightly to the face 18' by the intermediate of a non-unified water film. Before the transfer nip Ns, the temperature T of the face 18' and of the web W and of the water film that makes the web adhere to the face 18' has been raised to such a level that the water present between the roll face 18' and the web W and partly in the structure of the web W is vaporized, and attains a vapor pressure $P_s$, as its volume is increased in the transfer nip $N_s$ when the web W is sucked towards the transfer fabric 44 by means of the negative pressure $P_o$ in the suction zone 40a of the roll 40. When there is water at the temperature T between the web W and the face 18', the maximum negative pressure that can arise here is the pressure $P_s$ of saturated vapor prevailing at the temperature T.

Air starts flowing into the bottom of the wedge space or opening nip A between the web W and the roll face 18' after the nip $N_s$ as soon as the gap formed between the roll face 18' and the outer face of the web W is wide enough in comparison with the velocity of the faces. As the resistance to flow of the paper web W is high enough, a negative pressure can be sucked between the paper web W and the transfer fabric 44, the absolute value of the negative pressure being $P_o<P_s$. The length of the transfer nip $N_s$ has been dimensioned such that there is time enough for generation of full negative pressure between the paper web W and the transfer fabric 44. For this purpose, the outer face of the mantle 41 of the transfer-suction roll 40 may be provided with a soft coating, by whose means the length of the transfer nip $N_s$ can be extended to make it large enough. In FIG. 3, the reference S denotes the point or line at which the paper web W is separated from the face 18', because in the gap A that is opened, no higher negative pressure can arise than the pressure $P_s$ of saturated water vapor corresponding to the temperature T.

The temperature T of the face 18' of the center roll 18 and of the web when they enter into the transfer nip $N_s$ is in the invention, as a rule, in the range of from about 50° C. to about 100° C., which corresponds to the range of pressure $P_s$ of saturated water vapor (absolute values) of from about 0.13 bar to about 1.0 bar. A temperature range that is particularly favorable and practical in view of the objectives of the invention is the range T≈ about 65° to about 75° C., which corresponds to the range of pressure of water vapor of $P_s$≈ about 0.25 bar to about 0.40 bar. Thus, for example, if the temperature T=65° C. is employed, the corresponding vapor pressure $P_s$≈0.25 bar, in which case, in a closed suction transfer, the absolute pressure $P_o$ in the suction zone 40a must be $P_o$<0.25 bar, i.e., in the suction zone 40a, there must be at least a negative pressure of (1.00–0.25) bar= 0.75bar. In one embodiment, the roll face 18' is heated to a temperature determined such that the second pressure compensates for negative pressure created in an opening nip A formed by the press roll 18 and the web W as it detaches from the mantle face of the press roll 18.

FIG. 4 shows an embodiment of the invention in which a static suction box 50 is employed instead of a revolving suction roll 40. Inside the suction box 50, two Suction chambers 50a and 50b are fitted, whose open ends are defined by horizontal sealing ribs 53, over which the transfer fabric 44 is passed. In the first suction zone 50a, such a negative pressure $P_o$ prevails that in the transfer nip $N_s$ the web W is separated from the roll face 18' as a closed draw. In the second suction zone 50b, there is a lower level of negative pressure (as a rule in a range of P1≈0.1 bar), whereby it is ensured that the web W follows the transfer fabric 44. The suction chambers 50a and 50b communicate with the suction ducts 55a and 55b of the suction box 50 by the intermediate of the pipes 54a and 54b. After the suction box 50, the web W is transferred on the transfer fabric 55 into a transfer nip formed by the rolls 32 and 45, after which the web W is separated from the transfer fabric 44 and is transferred onto the support of the press felt 26, to which it is made to adhere by means of the negative pressure in the suction box 33.

The temperature level T of the web W and the roll face 18' that enter into the transfer nip $N_s$ is regulated to a level suitable in view of the invention by means of internal heating systems 18b in the roll 18 or by means of steam boxes 17 and/or 20. The internal heating systems in the roll 18 may also include heating media passed into the interior of the roll mantle 18a, such as steam or hot water. In addition to the devices mentioned above, it is also possible, as is shown in FIG. 2, to employ a heater placed before the transfer nip $N_s$, preferably an induction heater 60, by whose means the temperature T of the roll face 18' is raised to a level suitable in view of the suction transfer and the closed draw of the web W in accordance with the invention. The induction heater 60 is connected with a unit 61 for the supply of electric power. If necessary, the induction heater 60 and the other heaters may also be arranged so that, by its means, the transverse temperature profile of the roll face 18' and the web W before the transfer nip $N_s$ and in the nip area is controlled so that the profile is optimal in view of the transfer of the web W, as a rule as uniform as possible, e.g., in view of the different properties of adhesion to the roll face 18' possessed by different pulp qualities.

It is a requirement for a successful closed transfer in accordance with the invention that the negative pressure present in the suction zone of the transfer-suction roll 40 is not effective for an excessively long time, in which case the vapor arising at the transfer point between the web W and the roll face 18' would have time to cool the space between the web W and the roll face 18' by the effect of the vaporization heat.

Even though, above, the invention has been described with reference to an environment of application in which a separate nip $N_4$ is employed, the invention can also be applied to a press section in which there is no separate nip $N_4$, but the web W is transferred as a closed draw from the fabric that runs over the transfer-suction roll 40 into the drying section, e.g., onto its drying wire, so that the press fabric 26 shown in FIGS. 1 and 2 corresponds to the drying wire in the first wire group, on which fabric the web W is passed as a single-wire draw through the first drying group.

Moreover, FIGS. 1 and 2 show such a "Sym-Press-II" press section in which the suction roll 16 forms two nips $N_1$ and $N_2$. The invention can also be applied to other press geometries, such as the assignee's "Sym-Press-O" press section in which, after the press-suction roll 16, the web W has a vertical draw supported by the fabric 12 and, instead of the press-suction roll 16, there is a separate press roll in connection with the center roll 18.

It is not always necessary that the negative pressure that prevails in the suction zone **40*a*,50*a* of the suction roll 40 or of the suction box 50 is exactly equal to the vapor pressure corresponding to the temperature T of the roll face 18 or of the web W, but in some special situations a lower level of negative pressure may also be adequate, which level is however, chosen such that it substantially promotes the detaching of the web W without a detrimentally high pulling tension applied to the web. This is the case, e.g., with thicker paper qualities and/or with stronger pulps. For example, if the temperature of the web W to be detached and of the roll face is T≈70° C., it corresponds to a pressure of saturated vapor of about 0.30 bar, in which case the negative pressure that is required is preferably 1–0.30 bar=0.7 bar. According to what was stated above, in particular cases, the invention can operate at a "level of negative pressure" estimated at about 80%, i.e., in the above example, the negative pressure $P_o$ employed in the suction zone 40*a*,50*a*** might be, at the minimum, of an order of 0.80–0.7 bar=0.56 bar.

The scope of the invention also includes such embodiments differing from the above in which the temperature level T of the face 18' of the center roll 18 is set at the level of T≧100° C., in which case, in the transfer of the web W, a zone with negative pressure is not necessarily needed inside the transfer fabric 23,44. According to the present-day estimation, however, the method and the device of the invention can be accomplished optimally so that expressly a suction zone **40*a*,50*a*** is employed in which a pressure $P_o$ lower than the atmospheric pressure has been set to prevail.

Even though, above and in the exemplifying embodiments illustrated in the figures, the invention has been described with reference to so-called compact and closed press sections, the invention can also be applied to presses in which separate press nips are employed, between which the web W has, e.g., a draw supported by a transfer fabric.

In the following, the patent claims will be given, and the various details of the invention may show variation within the scope of the inventive idea defined in the claims and differ from what has been stated above for the sake of example only.

I claim:

1. Method for detaching a web from a smooth mantle face of a press roll in a press section of a paper machine, said press section having a closed draw transfer zone extending substantially between a point at which a transfer surface engages the web carried on said smooth mantle face and a point at which the web is separated from said smooth mantle face of said press roll for transfer to the transfer surface and in which a first negative pressure is applied through a transfer press element with which said transfer surface is associated, comprising the steps of:

simultaneous with the application of negative pressure to said transfer zone, heating the web and/or the mantle face of said smooth-faced press roll such that in said transfer zone, the temperature of the web and/or the mantle face is greater than about 50° C. and less than about 100° C. causing water between the mantle face of said smooth-faced press roll and the web and/or in the web to be heated and then vaporized in said transfer zone, the water vapor having a second pressure, and regulating the first pressure and the temperature to which the web and/or mantle face is/are heated, to thereby regulate the second pressure, as a function of each other such that the absolute value of the second pressure is substantially equal to or greater than the absolute value of the first pressure.

2. The method of claim 1, further comprising the step of:

selecting the first pressure applied in said transfer zone to be at least about 80% of the second pressure the saturated water vapor corresponding to the heating temperature of the mantle face of the smooth-faced press roll and/or the web, and controlling the transverse profile of the heating temperature of the web and/or the mantle face of said smooth-faced press roll.

3. The method of claim 1, wherein said transfer press element comprises a transfer-suction roll, further comprising the steps of:

forming a transfer nip in said transfer zone by arranging said transfer-suction roll in a nip-defining relationship with said smooth-faced press roll, forming a first press nip against said smooth-faced center roll, carrying the web on a fabric through said first nip and into said transfer zone, and transferring the web in said transfer nip from said smooth-faced press roll to said transfer-suction roll as a closed draw without a substantial pulling or speed difference.

4. The method of claim 1, wherein said transfer press element comprises a transfer-suction roll, further comprising the steps of:

forming a transfer nip in said transfer zone by arranging said transfer-suction roll in a nip-defining relationship with said smooth-faced press roll, carrying the web on a transfer fabric through said transfer zone into contact with the web without earlier contacting the web, and transferring the web in the nip from said smooth-faced press roll to said transfer-suction roll as a closed draw without a substantial pulling or speed difference.

5. The method of claim 1, wherein said transfer press element comprises a static transfer-suction box, further comprising the steps of:

arranging said static transfer-suction box in said transfer zone, said transfer-suction box having at least one suction zone, and forming a closed web transfer area in association with said at least one suction zone in connection with the mantle face of said smooth-faced press roll.

6. The method of claim 1, wherein the mantle face of said smooth-faced press roll is heated, the method further consisting of the step of:

regulating the first pressure applied in said transfer zone within a range of from about 0.13 bar to about 1.0 bar.

7. The method of claim 1, further comprising the steps of:

transferring the web in said transfer zone onto a first fabric, passing the first fabric carrying the web thereon as a closed draw into a first press nip, and transferring the web from the first fabric onto a second fabric in a second press nip or onto a drying wire for carrying the web into a drying section.

8. The method of claim 1, further comprising the steps of:

arranging a press roll to define a first press nip with said smooth-faced press roll, carrying the web on said smooth-faced press roll through said first nip into contact with a press fabric, separating the fabric from the web, and then passing the fabric over said transfer press element such that the web recontacts the fabric in said transfer zone and is transferred thereto.

9. The method of claim 1, further comprising the step of:

arranging a press roll to define a first press nip with said smooth-faced press roll, carrying the web on said smooth-faced press roll through said first nip into contact with a first fabric, separating the first fabric from the web, passing a second fabric into contact with the web in said transfer zone to receive the web from said smooth-press roll, and heating the web after the first fabric has been separated therefrom and before the second fabric contacts the web.

10. The method of claim 1, further comprising the step of:

regulating the first pressure and the temperature which provides the second pressure as a function of each other to prevent the formation of a vacuum in an opening nip defined by the web after it has separated from said smooth-faced press roll and said smooth-faced press roll and to provide a pressure difference in said transfer zone which produces a force field forcing the web from the smooth-faced press roll to said transfer element.

11. The method of claim 1, further comprising the steps of:

arranging at least one press roll in a nip-defining relationship with said smooth-faced press roll, carrying the web on said smooth-faced press roll and through said nip, and heating the entire circumference of the mantle face of said smooth-faced press roll in an area of the vicinity of said transfer zone and in areas outside of the vicinity of said transfer zone to intensify and improve the dewatering of the web.

12. The method of claim 1, wherein the mantle face of said smooth-faced press roll is heated, further comprising the step of:

determining the temperature to which the mantle face is heated such that the second pressure compensates for negative pressure created in an opening nip formed by said smooth-faced press roll and the web as it detaches from the mantle face of said smooth-faced press roll.

13. The method of claim 1, wherein said press section includes at least one press nip formed in conjunction with said press roll and situated immediately before said transfer zone in a running direction of the web, the web and/or the mantle face of said smooth-faced press roll being after said at least one press nip.

14. The method of claim 1, wherein said press section includes at least one press nip formed in conjunction with said press roll and situated immediately before said transfer zone in a running direction of the web, the web and/or the mantle face of said smooth-faced press roll being heated from a source other than said smooth-faced press roll at a location after said at least one press nip and before said transfer zone.

15. Press section of a paper machine, comprising a plurality of press rolls over which is arranged to run, at least two of said rolls being arranged in a nip-defining relationship such that a press nip is formed, a first one of said press rolls having a smooth mantle face, a transfer press element defining a transfer zone extending substantially between a point at which a transfer surface engages the web carried on said smooth mantle face of said first roll and a point at which the web is seperated from said smooth mantle face of said press roll for transfer to said transfer surface such that the web is transferred in a closed draw from said smooth mantle face of said first roll onto said transfer surface, suction means for subjecting the web to a negative pressure in said transfer zone at least prior to detachment of the web from the smooth face of said smooth-faced roll, said suction means being arranged in conjunction with said transfer press element such that suction is applied and air is drawn from said transfer zone through said transfer press element, said suction means applying a first negative pressure in said transfer zone through said transfer press element, heating means other than said smooth-faced roll for heating the web and/or the mantle face of said smooth-faced roll at a location between said press nip and said transfer zone such that the temperature of the web and/or the mantle face in said transfer zone is greater than about 50° C. and less than about 100° C. causing water between the mantle face and the web and/or in the web to be heated and then vaporized in said transfer zone, the water vapor having a second pressure, and regulation means for regulating the magnitude of negative pressure applied by said suction means and the temperature to which said heating means beat the web and/or the smooth mantle face of said smooth-faced roll in relation to each other such that the absolute value of the second pressure is substantially equal to or greater than the absolute value of the first pressure.

16. The press section of claim 15, wherein said transfer press element comprises a revolving suction-transfer roll defining a transfer nip with said smooth-faced roll in said transfer zone.

17. The press section of claim 15, wherein said transfer press element comprises a static suction-transfer box.

18. The press section of claim 15, wherein said smooth-faced roll comprises a center roll of a compact and closed press section, and wherein said heating means heat the smooth face of said smooth-faced roll, said heating means being selected from the group consisting of a steam box and an induction heater arranged in connection with said smooth-faced roll.

19. The press section of claim 15, further comprising a first fabric running through said transfer zone, the web being detached from said smooth-faced roll and being passed to said first fabric in said transfer zone, means defining a transfer nip after said transfer zone, the web being passed into said transfer nip on said first fabric and transferred from said first fabric therein, a second fabric running through said transfer nip and onto which the web is transferred in said transfer nip, and an additional nip defined by another pair of said press rolls, the web being carried on said second fabric into said additional nip.

20. In a device in a press section for aiding in the transfer of a web from a press roll having a smooth mantle face and to intensify and improve the dewatering of the web passing through at least one nip defined by said smooth-faced press roll and a press roll, the device including a transfer press element defining a transfer zone extending substantially between a point at which a transfer surface engages the web carried on said smooth mantle face of said press roll and a point at which the web is separated from said smooth mantle face of said press roll for transfer to said transfer surface such that the web is transferred in a closed draw from said smooth mantle face of said press roll onto said transfer surface, the device further including suction means for subjecting the web to a negative pressure in said transfer zone at least prior to detachment of the web from said smooth mantle face of said press roll, said suction means being arranged in conjunction with said transfer press element such that suction is applied and air is drawn from said transfer zone through said transfer press element, said suction means applying a first negative pressure in said transfer zone through said transfer press element, the improvement comprising heating means other than said smooth-faced roll for heating the web and/or the mantle face of said smooth-faced roll at a location between said press nip and said transfer zone to a temperature greater than about 50° C. and less than about 100° C. causing water between the mantle face and the web and/or in the web to be heated and then vaporized in said transfer zone, the water vapor having a second pressure, and regulation means for regulating the magnitude of suction applied through said transfer press element via said suction means and the temperature to which said heating means heat the entire circumference of the mantle face of said smooth-faced press roll in relation to each other such that the absolute value of the second pressure is substantially equal to or greater than the absolute value of the first pressure.

* * * * *